US005323848A

United States Patent [19]

Naty et al.

[11] Patent Number: 5,323,848

[45] Date of Patent: Jun. 28, 1994

[54] HEAT EXCHANGER, IN PARTICULAR A VEHICLE RADIATOR, AND A SIDE SUPPORT STRUCTURE FOR SUCH A HEAT EXCHANGER

[75] Inventors: Jean-Claude Naty, Argenteuil; Jean-Francois Iem, Meudon, both of France

[73] Assignee: Valeo Thermique Moteur, Le Mesnil-Saint-Denis, France

[21] Appl. No.: 51,152

[22] Filed: Apr. 22, 1993

[30] Foreign Application Priority Data

Apr. 24, 1992 [FR] France ..... 92 05112

[51] Int. Cl.[5] ..... P28F 9/00

[52] U.S. Cl. ..... 165/149; 165/67

[58] Field of Search ..... 165/149, 67, 78

[56] References Cited

U.S. PATENT DOCUMENTS

| | | | |
|---|---|---|---|
| 1,784,766 | 12/1930 | Stranahan . | |
| 2,932,489 | 4/1960 | Young | 165/149 |
| 3,165,151 | 1/1965 | Astrup et al. | 165/149 X |
| 3,627,035 | 12/1971 | Astrup | 165/149 X |
| 4,534,407 | 8/1985 | Lardner | 165/149 X |
| 4,619,313 | 10/1986 | Rhodes et al. | 165/67 |

FOREIGN PATENT DOCUMENTS

| | | | |
|---|---|---|---|
| 307803 | 3/1989 | European Pat. Off. | 165/149 |
| 2126577 | 12/1972 | Fed. Rep. of Germany | 165/67 |
| 3215422 | 10/1983 | Fed. Rep. of Germany | 165/67 |
| 8629407 | 3/1987 | Fed. Rep. of Germany | F28D 1/03 |
| 0256913 | 2/1988 | France | F28F 9/00 |
| 2098313 | 11/1982 | United Kingdom | F28F 9/02 |

*Primary Examiner*—John Rivell
*Assistant Examiner*—L. R. Leo
*Attorney, Agent, or Firm*—Morgan & Finnegan

[57] ABSTRACT

A heat exchanger comprises a bundle of tubes opening at the bottom into a fluid header extending transversely and secured through a pair of side support structures to an upper fluid header. Each side support structure extends along a flank of the tube bundle, and has a lower portion in the form of a fastening lug formed with fastening holes for securing to the lower header at different levels, so that heat exchangers of different lengths can be made using the same headers and side support structure. This fastening lug is offset away from the flank of the tube bundle so as to accommodate a header having a length longer than the width of the tube bundle, and baffles are cut out in the fastening lug so that they can be bent towards the tube bundle where appropriate in order to form a barrier to the passage of air between the tubes and the lug if a fastening position other than that furthest away from the lower end of the support structure is chosen.

6 Claims, 2 Drawing Sheets

HEAT EXCHANGER, IN PARTICULAR A VEHICLE RADIATOR, AND A SIDE SUPPORT STRUCTURE FOR SUCH A HEAT EXCHANGER

FIELD OF THE INVENTION

This invention relates to an elongate side support structure, or transverse, for a heat exchanger, the side support structure being arranged to extend along one flank of a bundle of tubes of the heat exchanger parallel to the said tubes, with the side support structure being assembled in one of the end regions of the support structure to an elongate fluid header extending transversely to the tube bundle, an end of each tube of the bundle being open into the header.

Such side support structures are used in particular for the assembly of large radiators used for cooling the engines of industrial vehicles. Because of their high cost, such radiators must be adapted for disassembly for the purposes of repair and maintenance.

BACKGROUND OF THE INVENTION

It is known to use the same fluid headers and the same cooling fins for radiators having different cooling capacities. These radiators differ from each other in the length of their tubes, and therefore in the length of their side support structures. Current practice is therefore to provide a range of sizes of side support structures.

DISCUSSION OF THE INVENTION

An object of the invention is to reduce the number of different components which it is necessary to manufacture and stock so that heat exchangers may be made in different sizes using one standard size of side support structure.

To this end, according to the invention a side support structure for a heat exchanger, adapted to extend along a flank of a bundle of tubes and parallel to the said tubes, being secured in one of its end regions to an elongate fluid header extending transversely to the tube bundle, with the ends of the tubes being open into the said header, is characterised in that the support structure defines at least two fastening positions, the fastening positions being spaced apart along the said end region of the support structure, so that they can be selectively used for assembly with the fluid header, whereby heat exchangers of different lengths can be made using the same side support structure.

Various preferred, but optional, features of the side support structure in accordance with the invention are set out below.

The structure preferably comprises a flat sole plate which is adapted to abut against the said flank of the tube bundle.

The sole plate is preferably joined to two longitudinal wing portions which are directed away from the surface of contact of the sole plate with the tube bundle, so that the side support structure has a U shaped profile.

The sole plate is preferably offset in its said end region so that the latter is spaced away from the surface of contact with the tube bundle, whereby to accommodate a fluid header which has a length greater than the width of the tube bundle.

At least one substantially rectangular baffle is preferably defined by a cut in the offset portion of the sole plate, the baffle defining one side thereof which is oriented in the longitudinal direction of the side support structure and which has a length substantially equal to the pitch between two successive ones of the said alternative fastening positions, whereby the baffle can be bent along that side. In this way, the baffle can extend either in the same plane as the said offset portion, i.e. facing towards the fluid header, when the fastening position furthest away from the end of the support structure is used, or transversely to that plane, i.e. so that it projects towards the corresponding flank of the tube bundle, whereby to act as a barrier to the flow of air between the tube bundle and the said offset portion of the sole plate. This latter alternative is chosen when the fastening position closest to the end of the offset portion is used. Substantially all of the air is thus forced to pass through the tube bundle, thus improving the heat transfer in the heat exchanger.

In addition, the side support structure may be engaged on the tube bundle over substantially the whole length of the latter, thus increasing the rigidity of the heat exchanger as a whole.

Preferably, there are at least three said fastening positions, the number of baffles defined above being one less than the number of said fastening positions, these baffles being substantially aligned with each other and juxtaposed in the longitudinal direction of the side support structure.

The said assembly means preferably comprise holes formed through the sole plate in the respective fastening positions, and arranged to receive screws which are screwed into the associated fluid header.

The invention is also directed to a heat exchanger comprising a bundle of tubes the ends of which are open into at least one fluid header, together with at least one side support structure according to the invention and extending along a flank of the tube bundle, the side support structure being assembled to the said fluid header by the said assembly means in a selected one of its fastening positions. Such a heat exchanger may, in particular, have two of these support structures extending along respective ones of the two opposed flanks of the tube bundle, the fastening position in which the support structures are secured to the header being the same for each support structure.

Further features and advantages of the invention will appear more clearly on a reading of the description of a preferred embodiment of the invention which follows, and which is given by way of example only and with reference to the accompanying drawings.

DESCRIPTION OF A PREFERRED EMBODIMENT OF THE INVENTION

Figure 1:
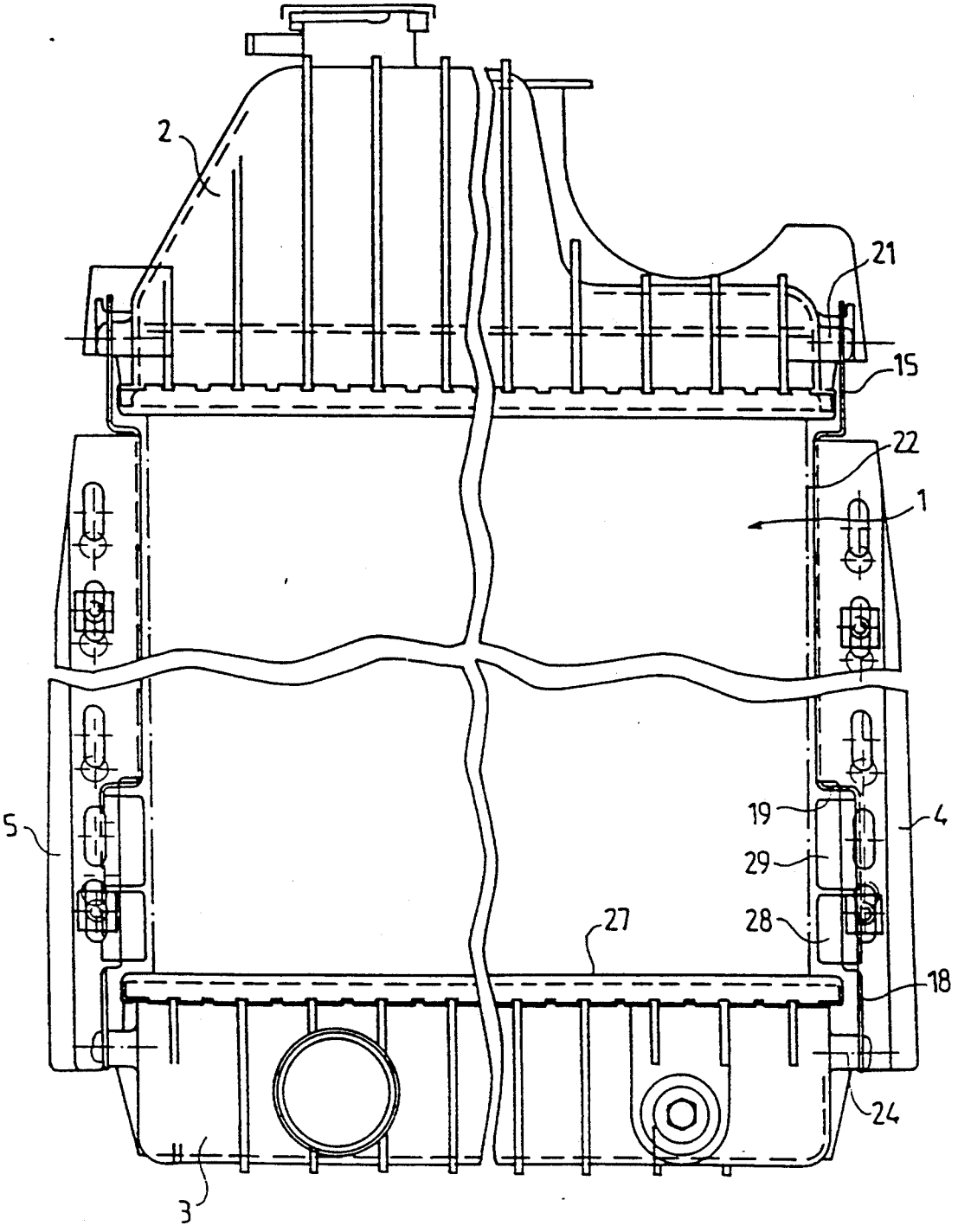
FIG. 1 is a view in elevation showing a radiator for an industrial vehicle in accordance with the invention.

The radiator shown in FIG. 1 comprises: a bundle of tubes 1 consisting of a series of vertical tubes and a series of fins (which are not shown in detail); an upper water heater header 2; and a lower water header 3. The two headers extend in a generally horizontal direction laterally with respect to the tube bundle 1. The upper ends of the tubes 1 are open into the upper header 2, while the lower ends of the tubes are open into the lower header 3. The radiator also includes two side support structures 4 and 5 which extend vertically and which are assembled with the two headers 2 and 3 through their respective end regions. The bundle of tubes 1 is flanked on either side by the side support structures 4 and 5.

The structures 4 and 5 are constructed in the same way as each other, and are symmetrical with each other with respect to a median vertical plane of the radiator. Therefore only the support structure 4 will be described here, with reference to FIGS. 2 to 4. The support structure 4 comprises a plate in the form of a sheet metal pressing, which is bent along two parallel longitudinal lines so as to define a portion 6 which will be referred to as the sole plate, together with two wing portions 7 and 8 joined to the sole plate 6.

In the upper end region of the structure 4, the two wing portions 7 and 8, and the marginal zones of the structure which lie adjacent to the latter, are eliminated by lateral cuts 9 and 10, so that the wings and marginal zones only exist along a central zone 11 of the sole plate 6. This residual zone is first bent, substantially at right angles away from the vertical base plane P of the sole plate 6 and in the same direction as the wings 7 and 8, along a substantially transverse line 12, thus forming a cranked portion 13. It is then again bent, substantially at right angles, along a further transverse line 14 so as to form a substantially flat portion in the form an upper fastening lug 15. This fastening lug 15 extends upwards, substantially parallel to the base plane P and away from the cranked portion 13, that is to say away from the main portion of the sole plate 6.

Figure 3:
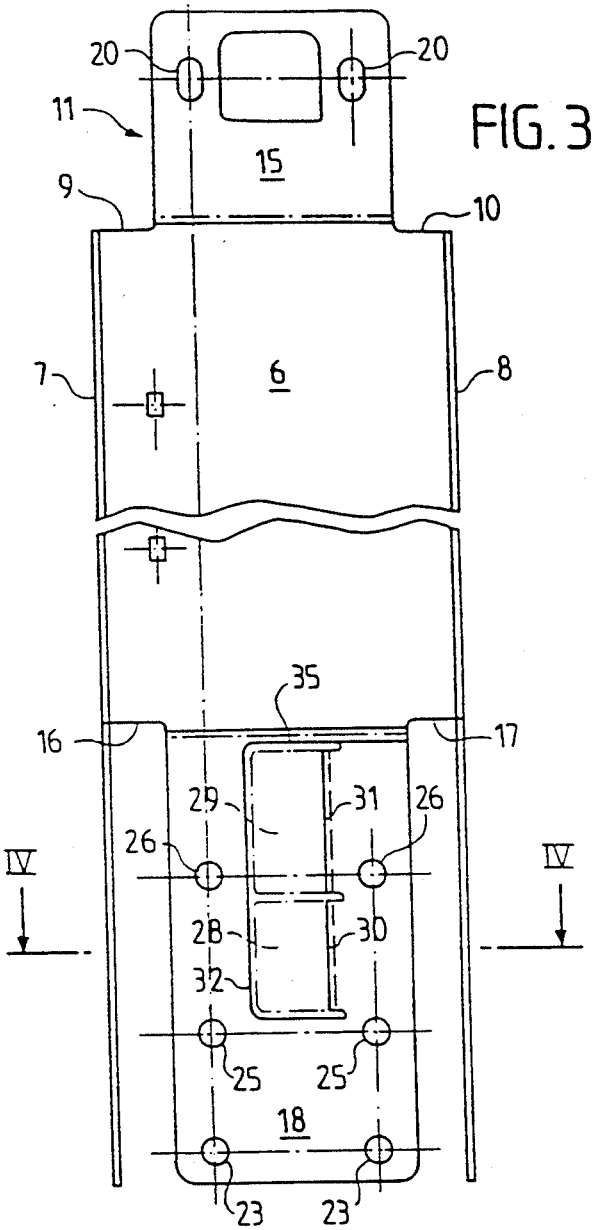
FIG. 3 shows the side support structure seen in FIG. 2, as seen from one side of the radiator.

The lower end region of the support structure 4 has the same configuration as described above for the upper end region except that the lateral cuts 16 and 17 in the lower portion (corresponding to the cuts 9 and 10) do not eliminate the wing portions 7 and 8 over their whole width, but only in the marginal zone of the latter which is adjacent to the sole plate 6. The residual portions of the wings extend in the same planes as the main portion of the latter, down to a point at which they are in line (as is best seen in FIG. 3) with the bottom edge of the offset lower end portion 18 of the sole plate 6. This end portion 18 constitutes a lower fastening lug, and extends parallel to the base plane P, being joined to the main part of the sole plate through a cranked portion 19.

The upper offset region, or fastening lug, 15 of the sole plate has two through holes 20 which are arranged symmetrically about a central longitudinal plane. The purpose of the holes 20 is to enable the support structure 4 to be assembled to the upper header 2, which is provided for this purpose with a boss 21 (FIG. 1), projecting from its end wall and having a flat surface on which the terminal lug 15 is abutted. This abutment surface of the boss 21 is offset toward the outside of the radiator with respect to the vertical plane containing the corresponding flank 22 of the bundle of tubes 1. The structure 4 and the header 2 are assembled together by means of screws which are engaged in the holes 20 and screwed into the boss 21. The heads of these screws force the lug 15 of the sole plate 6 against the abutment surface of the boss 21.

The support structure 4 is assembled to the lower water header 3 in the same way, by virtue of two holes 23 formed through the lower fastening lug 18 of the sole plate 6 and disposed symmetrically with respect to the longitudinal central plane, co-operatng with a boss 24 projecting from the end wall of the water header 3.

The offset lower fastening lug 18 has two other pairs of holes, 25 and 26 respectively. These holes are aligned vertically with the holes 23 as shown in FIG. 3, with the two holes of each pair 25 or 26 being aligned horizontally with each other. The pairs of holes 23, 25 and 26 define three assembly or fastening positions, any one of which can be selected so that the same water header 3 can be fitted to a given support structure 4 at decreasing distances from the upper water header 2, so that radiators of decreasing heights can be made.

The offsets of the upper and lower fastening lugs of the sole plate 6 with respect to the base plate P of the latter may be unequal. These offsets correspond to the offsets of the abutment faces of the bosses 21 and 24 of the two water headers with respect to the plane of the flank 22 of the tube bundle. This enables the sole plates 6 to be abutted, in practice, in the plane 22. The cranked portion 19 enables the lower fastening lug 18 to be offset so as to provide space for accommodating the end of the lower water header 3, including the collector 25 which forms the upper wall of the latter, when the uppermost pair of fastening holes 26 in the lower lug 18 is used for assembly to the header.

By contrast, the cranked portion 19 lies at an appreciable distance above the collector 27 when either the pair of holes 23 or the pair 25 is used. Thus a free space is defined between the cranked portion 19 at the top and the collector 27 at the bottom. This space is limited on the left by the flank 22 of the tube bundle and on the right by the lower fastening lug 18. In order to prevent air from passing into this free space instead of passing through the tube bundle 11, thus reducing the efficiency of the radiator—or at least to limit such air flow—two baffles 28 and 29 are provided.

Figure 2:
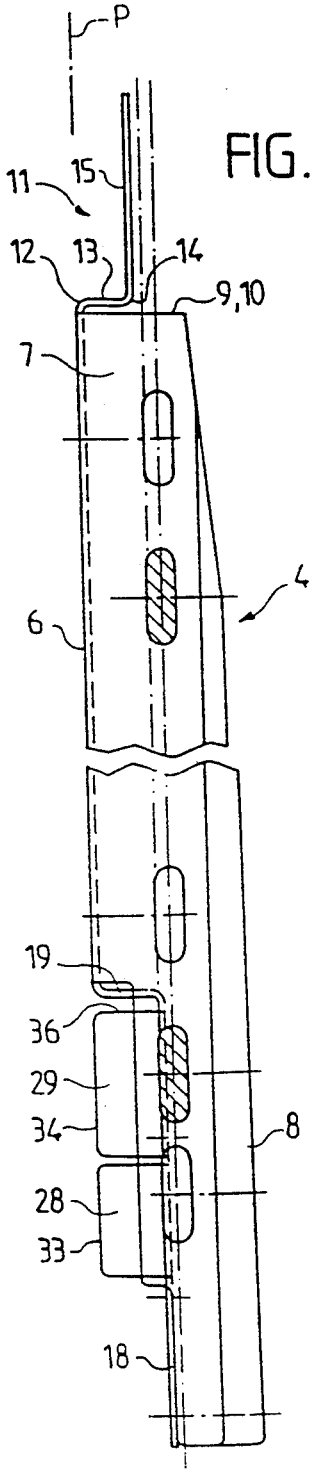
FIG. 2 is a view corresponding to FIG. 1, showing one of the two side support structures of the radiator on a larger scale.
Figure 4:
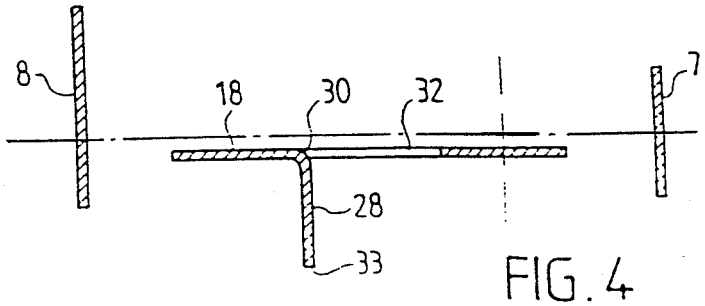
FIG. 4 is a view in cross section, taken on the line IV—IV in FIG. 3 but on a larger scale.

These baffles are formed by cutting through the metal of the lower fastening lug 18 of the sole plate, being joined to the lug 18 through two bend lines 30 and 31 aligned with each other in the longitudinal direction of the structure 4. The two baffles are both rectangular, with one side of the rectangle being defined by the line 30, 31 (FIG. 3). Before being bent away from the plane of the lug 18, the baffles lie within a cut 32 defining three sides of a rectangle, the width of which is slightly greater than the width of each baffle 28 or 29, its height being slightly greater than the sum of the heights of the two baffles, as can be seen in phantom lines in FIG. 3. The width of the baffles is substantially equal to the distance between the base plane P and the plane of the lower fastening lug 18, so that if they are bent at 90° towards the plane P as shown in FIGS. 1, 2 and 4, their edges 33 and 34 opposed to the bend lines 30 and 31 lie substantially in that plane. In addition, the upper edges 35 and 36 of the cut 32 and of the baffle 29 are very close to the cranked portion 19.

The height of the baffle 29 corresponds to the vertical distance between the axes of the holes 23 and the holes 25, while the vertical height of the baffle 29 corresponds to the vertical height between the axes of the holes 25 and the holes 26. When the two baffles are bent back in this way as shown in FIG. 1, they extend across the free space mentioned above, so as to block the greater part of the corresponding air flow cross section. The same result is obtained by bending the single baffle 29 at right angles to the base plane P when the lower water header 3 is assembled to the support structure 4 using the holes 25.

What is claimed is:

1. A heat exchanger comprising: a bundle of tubes defining a pair of opposed flanks of the bundle; at least one elongate fluid header extending transversely to the tube bundle, with ends of the tubes being open in to the header; at least one side support structure extending along a flank of the tube bundle, parallel to the tube bundle, each side support structure comprising a flat sole plate for abutment against said flank of the tube bundle and including a first end portion and a second end portion wherein the first end portion of the side support structure is offset laterally away from the plane of contact of the sole plate with the tube bundle so as to accommodate the fluid header larger than the width of the tube bundle; and means securing the said first end portion of the support structure to the said header, wherein the said securing means include a plurality of fastening means located on the said first end portion of the securing structure, said fastening means being spaced away from each other along the first end portion, whereby any one of the fastening means can be selected so as to enable the heat exchanger to be made to a selected one of the a number of lengths corresponding to the number of said fastening means.

2. A heat exhanger according to claim 1 wherein each support structure further includes two longitudinal wing portions joined to the sole plate and directed away from the plane of contact of the sole plate with the tube bundle, whereby the support structure has a U shaped profile.

3. A heat exchanger according to claim 1 wherein the first end portion of each side support structure includes at least one substantially rectangular baffle, defined in a cut formed in the offset first end portion of the sole plate and defining a side thereof which is oriented in the longitudinal direction of the support structure, the side having a length and direction which is substantially equal to the pitch between two selectable fastening means, whereby the baffle extends in the plane of the first end portion facing towards the associated fluid header when the fastening means furthest from the end of the support structure is used, and whereby the baffle can be bent along its side so as to extend transversely to the plane in projection towards the associated flank of the tube bundle when the fastening means closest to the end of the support structure are used, thereby restricting the passage of air between the tube bundle and the offset first end portion.

4. A heat exchanger according to claim 5 wherein the support structure has at least three fastening means and a number of baffles which is one less than the number of the fastening means, the baffles being substantially aligned with each other and juxtaposed in the longitudinal direction of the support structure.

5. A heat exchanger according to claim 1 wherein the securing means comprise holes formed through the sole plate, and screws passing through the holes and screwed into the fluid header.

6. A heat exchanger according to claim 1 including a pair of side support structures each extending a long a respective one of the two flanks of the tube bundle and the selected fastening means whereby one support structure is secured to the fluid header and is selected so as to correspond to the fastening means by which the other support structure is secured to the header.

* * * * *

UNITED STATES PATENT AND TRADEMARK OFFICE

CERTIFICATE OF CORRECTION

PATENT NO. : 5,323,848

DATED : June 28, 1994

INVENTOR(S) : Jean-Claude Naty, et al

It is certified that error appears in the above-indentified patent and that said Letters Patent is hereby corrected as shown below:

Column 6, line 16, replace "five" with --three--.

Signed and Sealed this

Thirteenth Day of September, 1994

*Attest:*

Bruce Lehman

BRUCE LEHMAN

*Attesting Officer*

*Commissioner of Patents and Trademarks*